US009765930B2

(12) United States Patent
Poorman

(10) Patent No.: US 9,765,930 B2
(45) Date of Patent: Sep. 19, 2017

(54) CNG FUELING SYSTEM

(71) Applicant: J-W Power Company, Addison, TX (US)

(72) Inventor: Richard Poorman, Diana, TX (US)

(73) Assignee: J-W POWER COMPANY, Addison, TX (US)

( * ) Notice: Subject to any disclaimer, the term of this patent is extended or adjusted under 35 U.S.C. 154(b) by 425 days.

(21) Appl. No.: 13/756,092

(22) Filed: Jan. 31, 2013

(65) Prior Publication Data

US 2013/0192701 A1 Aug. 1, 2013

Related U.S. Application Data

(60) Provisional application No. 61/593,134, filed on Jan. 31, 2012.

(51) Int. Cl.
*F17C 5/02* (2006.01)
*F17C 5/00* (2006.01)

(52) U.S. Cl.
CPC ..... *F17C 5/02* (2013.01); *F17C 5/00* (2013.01); *F17C 2201/056* (2013.01); *F17C 2201/058* (2013.01); *F17C 2221/033* (2013.01); *F17C 2223/0123* (2013.01); *F17C 2223/033* (2013.01); *F17C 2225/0123* (2013.01); *F17C 2225/035* (2013.01); *F17C 2225/036* (2013.01); *F17C 2227/0164* (2013.01); *F17C 2227/04* (2013.01); *F17C 2250/075* (2013.01); *F17C 2260/025* (2013.01); *F17C 2265/065* (2013.01); *F17C 2270/0168* (2013.01); *Y10T 137/86035* (2015.04)

(58) Field of Classification Search
CPC F17C 5/06; F17C 2221/033; F17C 2223/036; F17C 2223/0123; F17C 2250/0636; F17C 2265/065
USPC ..... 141/4, 18; 417/423.14
See application file for complete search history.

(56) References Cited

U.S. PATENT DOCUMENTS

| | | | |
|---|---|---|---|
| 2,478,321 | A | 8/1949 | Robbins |
| 3,719,196 | A | 3/1973 | McJones |
| 3,847,173 | A | 11/1974 | Hill |
| 4,522,159 | A | 6/1985 | Engel et al. |
| 4,527,600 | A | 7/1985 | Fisher et al. |
| 4,585,039 | A | 4/1986 | Hamilton |
| 4,646,940 | A | 3/1987 | Kramer et al. |
| 4,653,986 | A | 3/1987 | Ashton |
| 4,750,869 | A | 6/1988 | Shipman, III |

(Continued)

FOREIGN PATENT DOCUMENTS

| | | | |
|---|---|---|---|
| CN | 100346103 | C | 10/2007 |
| CN | 100575770 | C | 12/2009 |

(Continued)

OTHER PUBLICATIONS

PCT International Search Report; PCT Application No. PCT/US2013/024156; Jun. 18, 2013; 5 pgs.

(Continued)

*Primary Examiner* — Patrick Hamo
(74) *Attorney, Agent, or Firm* — Lightfoot & Alford PLLC

(57) ABSTRACT

A compressed natural gas (CNG) fueling system has a single compressor, a storage tank configured to receive CNG from the compressor, and a CNG feedback to the compressor from the storage tank.

10 Claims, 11 Drawing Sheets

(56) References Cited

U.S. PATENT DOCUMENTS

| | | | | |
|---|---|---|---|---|
| 4,966,206 | A | | 10/1990 | Baumann et al. |
| 5,073,090 | A | | 12/1991 | Cassidy |
| 5,107,906 | A | | 4/1992 | Swenson et al. |
| 5,259,424 | A | | 11/1993 | Miller et al. |
| 5,263,826 | A | * | 11/1993 | Baumann et al. ..... 417/310 |
| 5,351,726 | A | * | 10/1994 | Diggins ..... 141/4 |
| 5,361,796 | A | | 11/1994 | Mutter |
| 5,370,159 | A | * | 12/1994 | Price ..... 141/4 |
| 5,385,176 | A | | 1/1995 | Price |
| 5,387,089 | A | | 2/1995 | Stogner et al. |
| 5,406,988 | A | | 4/1995 | Hopkins |
| 5,409,046 | A | | 4/1995 | Swenson et al. |
| 5,454,408 | A | | 10/1995 | DiBella et al. |
| 5,474,104 | A | | 12/1995 | Borland et al. |
| 5,479,966 | A | | 1/1996 | Tison et al. |
| 5,488,978 | A | | 2/1996 | Kountz et al. |
| 5,505,232 | A | | 4/1996 | Barclay |
| 5,538,051 | A | | 7/1996 | Brown et al. |
| 5,570,729 | A | | 11/1996 | Mutter |
| 5,673,735 | A | | 10/1997 | Crvelin et al. |
| 5,694,985 | A | | 12/1997 | Diggins |
| 5,752,552 | A | | 5/1998 | Kountz et al. |
| 5,771,947 | A | | 6/1998 | Kountz et al. |
| 5,771,948 | A | | 6/1998 | Kountz et al. |
| 5,810,058 | A | | 9/1998 | Kountz et al. |
| 5,884,675 | A | | 3/1999 | Krasnov |
| 5,974,369 | A | | 10/1999 | Radtke et al. |
| 6,152,191 | A | | 11/2000 | Chan et al. |
| 6,435,269 | B1 | | 8/2002 | Hancock |
| 6,439,278 | B1 | | 8/2002 | Krasnov |
| 6,619,336 | B2 | | 9/2003 | Cohen et al. |
| 6,652,243 | B2 | | 11/2003 | Krasnov |
| 6,722,399 | B1 | | 4/2004 | Cano |
| 6,779,568 | B2 | | 8/2004 | Borck |
| 6,792,981 | B1 | | 9/2004 | Manning et al. |
| 6,851,657 | B2 | | 2/2005 | Tawns |
| 7,059,364 | B2 | | 6/2006 | Kountz et al. |
| 7,150,299 | B2 | | 12/2006 | Hertzler et al. |
| 7,152,637 | B2 | | 12/2006 | Hoke, Jr. |
| 7,168,464 | B2 | | 1/2007 | Diggins |
| 7,415,995 | B2 | | 8/2008 | Plummer et al. |
| 7,967,036 | B2 | | 6/2011 | Ding et al. |
| 8,122,918 | B2 | | 2/2012 | Handa |
| 8,267,670 | B2 | | 9/2012 | Adler et al. |
| 8,281,820 | B2 | | 10/2012 | White |
| 8,360,112 | B2 | | 1/2013 | Allidieres et al. |
| 8,453,682 | B2 | | 6/2013 | Bonner et al. |
| 8,613,201 | B2 | | 12/2013 | Bayliff et al. |
| 8,833,088 | B2 | | 9/2014 | Bayliff et al. |
| 8,839,829 | B2 | | 9/2014 | Ding et al. |
| 8,899,278 | B2 | | 12/2014 | Cohen et al. |
| 8,978,715 | B2 | | 3/2015 | Allidieres |
| 2001/0029979 | A1 | | 10/2001 | Zheng et al. |
| 2001/0039961 | A1 | | 11/2001 | Zheng et al. |
| 2003/0197142 | A1 | | 10/2003 | Tawns |
| 2007/0009369 | A1 | | 1/2007 | Dany |
| 2007/0051423 | A1 | | 3/2007 | Handa |
| 2009/0250138 | A1 | | 10/2009 | Bavarian et al. |
| 2010/0037982 | A1 | | 2/2010 | Bangs et al. |
| 2010/0059138 | A1 | | 3/2010 | Shi et al. |
| 2011/0155278 | A1 | | 6/2011 | Ding |
| 2011/0240139 | A1 | | 10/2011 | Ding et al. |
| 2013/0192701 | A1 | | 8/2013 | Poorman |
| 2013/0248000 | A1 | | 9/2013 | Killeen et al. |
| 2014/0130938 | A1 | | 5/2014 | Luparello |
| 2014/0202585 | A1 | | 7/2014 | Barker |
| 2014/0261863 | A1 | | 9/2014 | Cohen et al. |
| 2014/0263420 | A1 | | 9/2014 | Lambrix et al. |
| 2015/0000757 | A1 | | 1/2015 | Bayliff et al. |
| 2015/0047738 | A1 | | 2/2015 | Wilson et al. |

FOREIGN PATENT DOCUMENTS

| | | | |
|---|---|---|---|
| CN | 201715234 | U | 1/2011 |
| CN | 201757268 | U | 3/2011 |
| CN | 101813237 | B | 6/2014 |
| DE | 102014000639 | A1 | 7/2014 |
| JP | 2005127430 | A | 5/2005 |
| JP | 3720925 | B2 | 11/2005 |
| JP | 2006283840 | A | 10/2006 |
| JP | 4751014 | B2 | 8/2011 |
| KR | 100699937 | B1 | 3/2007 |
| RU | 2208199 | C1 | 7/2003 |
| WO | 9622915 | A1 | 8/1996 |
| WO | 2006031365 | A2 | 3/2006 |
| WO | 2009072160 | A2 | 6/2009 |
| WO | 2009072160 | A3 | 6/2009 |

OTHER PUBLICATIONS

PCT Written Opinion of the International Searching Authority; PCT/US2013/024156; Jun. 18, 2013; 6 pgs.

BRC Fuel Maker, "The full line for CNG refueling solutions", TA01Z017I-3, Jun. 2010, 16 pages, MTM P&P Dept.

* cited by examiner

CNG FUELING SYSTEM

CROSS-REFERENCE TO RELATED APPLICATIONS

The present application claims priority to U.S. Provisional Patent Application No. 61/593,134, filed on Jan. 31, 2012 by Richard Poorman, entitled "CNG Fueling System" which is incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some compressed natural gas (CNG) fueling systems are configured for operation with relatively high natural gas source pressures. In some cases, CNG fueling systems comprise multiple compressors, multiple compressor crankshafts, and/or multiple compressor driver devices. In some cases, CNG fueling systems comprise multiple CNG storage tanks and/or are not capable of filling a fuel tank quickly.

SUMMARY

In some embodiments of the disclosure, a compressed natural gas (CNG) fueling system is disclosed as comprising a single compressor, a storage tank configured to receive CNG from the compressor, and a CNG feedback to the compressor from the storage tank.

In other embodiments of the disclosure, a method of operating a compressed natural gas (CNG) fueling system is disclosed as comprising providing a single compressor, storing CNG compressed by the compressor, and further compressing the stored CNG using the compressor.

In yet other embodiments of the disclosure, a compressed natural gas (CNG) fueling system is disclosed as comprising a single separable reciprocating gas compressor comprising a plurality of compression stages, a storage tank configured to receive CNG from the compressor, and a feedback configured to provide CNG from the storage tank to at least one of the plurality of compression stages.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

In some cases, it may be desirable to provide a CNG refueling system capable of speedily refueling a vehicle storage tank and/or any other suitable CNG related device without multiple compressors, multiple compressor drivers, and/or a high pressure natural gas source. In some embodiments, this disclosure provides a CNG refueling system comprising one compressor, one compressor driver, and/or a low pressure natural gas source. In some embodiments, the above-described CNG refueling system may be configured to feed CNG previously compressed by the compressor back into the same compressor and to transfer the recompressed CNG to a vehicle storage tank.

Figure 1:
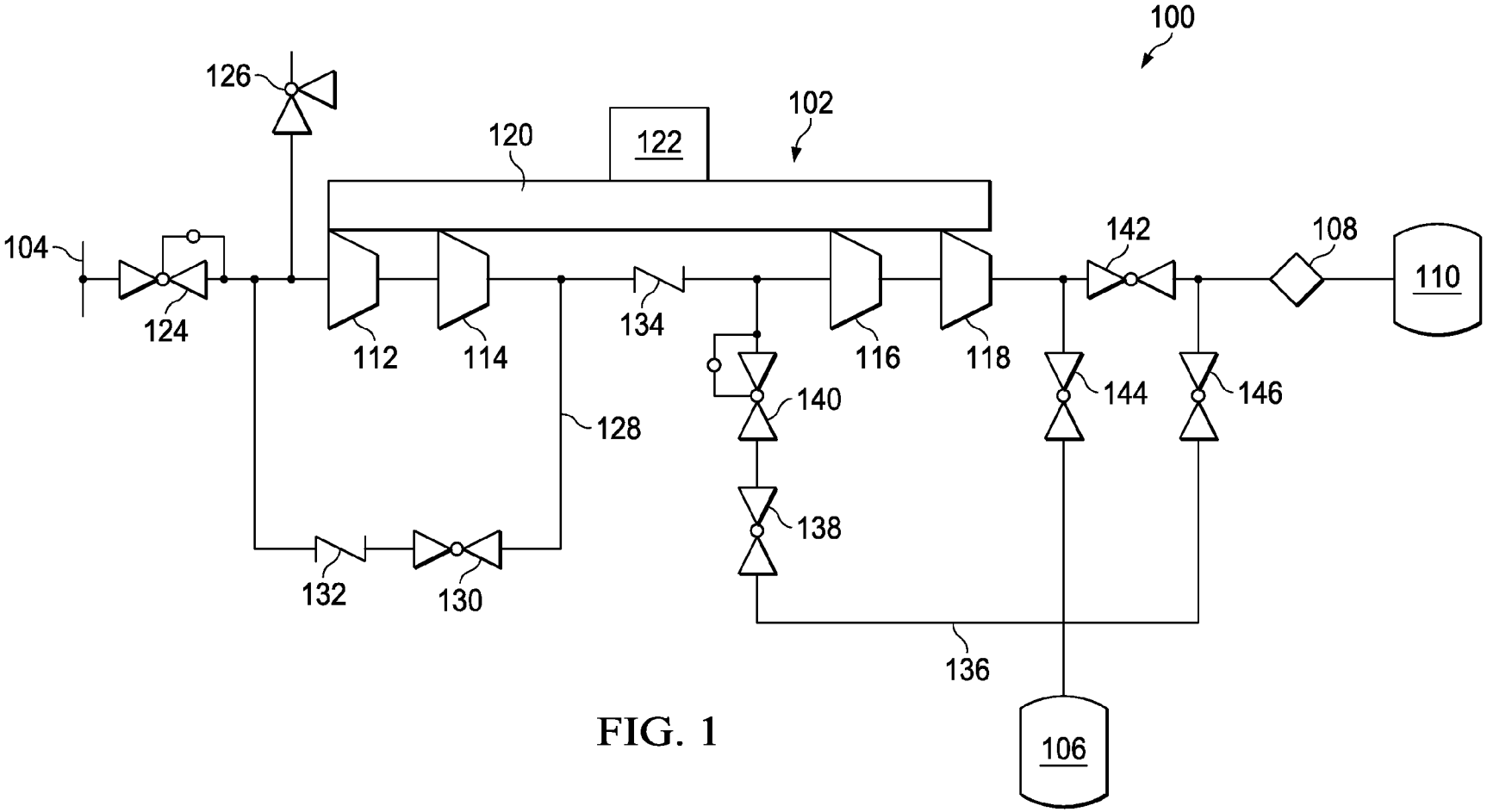
FIG. 1 is a schematic diagram of a CNG fueling system according to an embodiment of the disclosure.

Referring now to FIG. 1, a schematic of a CNG fueling system 100 is shown according to an embodiment of the disclosure. The CNG fueling system 100 may generally comprise a compressor 102, a natural gas source 104, a storage tank 106, and a CNG dispenser 108. The CNG fueling system 100 may comprise a vehicle storage tank 110 and/or the CNG fueling system 100 may be configured to selectively transfer CNG to the vehicle storage tank 110. In this embodiment, the compressor 102 comprises four stages of compression represented by a first compression stage 112, a second compression stage 114, a third compression stage 116, and a fourth compression stage 118. In this embodiment, each of the compression stages 112, 114, 116, 118 may be powered by a power transfer device 120 that may comprise a single primary crankshaft that may drive pistons of the compression stages 112, 114, 116, 118 in a reciprocating manner within associated bores of the compression stages 112, 114, 116, 118. As such, the compressor 102 may comprise a separable reciprocating gas compressor. In some cases, the power transfer device 120 may be driven by a compressor driver 122, such as, but not limited to an electrical motor, a natural gas fueled engine, a turbine, an internal combustion engine, and/or any other device suitable for providing rotational power input and/or torque power input to the power transfer device 120. In alternative embodiments, the compressor 102 may comprise more or fewer compression stages, a rotary compressor, a scroll compressor, a pneumatic and/or hydraulically powered compressor, additional power transfer devices 120, additional compressor drivers 122, and/or any other suitable means for selectively compressing natural gas.

In this embodiment, the natural gas source 104 may comprise a relatively low source pressure of less than about 350 psig, between about 5 psig to about 330 psig, between about 70 psig to about 330 psig, between about 275 psig to about 325 psig, and/or about 300 psig. A source regulator valve 124 may be configured to limit a natural gas pressure provided to the compressor 102, namely in this embodiment, the natural gas pressure provided to the first compression stage 112. In some cases, the source regulator valve 124 may be adjusted to comprise a high pressure limit of less than about 350 psig, between about 5 psig to about 330 psig, between about 40 psig to about 330 psig, between about 275 psig to about 325 psig, and/or about 300 psig. In some cases, a pressure release valve 126 may be provided to selectively reduce pressure provided to the compressor 102, namely in this embodiment, the natural gas pressure provided to the first compression stage 112. In some cases, the pressure release valve 126 may be selected and/or adjusted to comprise a release pressure of less than about 350 psig, between about 5 psig to about 330 psig, between about 40 psig to about 330 psig, between about 275 psig to about 325 psig, and/or about 300 psig. In some embodiments, the pressure release valve 126 may be set to comprise a release pressure higher than the high pressure limit of the source regulator valve 124. In some cases, the pressure release valve 126 may operate to release natural gas to atmosphere or storage.

In some embodiments, a stage bypass 128 may be provided in selective fluid communication with the natural gas source 104 and an output of the second compression stage 114. The stage bypass 128 may comprise a stage bypass valve 130 operable to selectively open and close the stage bypass 128. The stage bypass 128 may further comprise a bypass check valve 132. Similarly, a second stage check valve 134 may be provided to prevent fluid from reaching the stage bypass 128 and/or the second compression stage 114 outlet from a storage feedback 136 that is in selective fluid communication with the storage tank 106 and the input to the third compression stage 116. A feedback valve 138 may be provided to selectively open and close the storage feedback 136. A feedback regulator valve 140 may be configured to comprise a high pressure limit equal to or less than a maximum pressure rating for an input of the third compression stage 116.

Figure 2A:
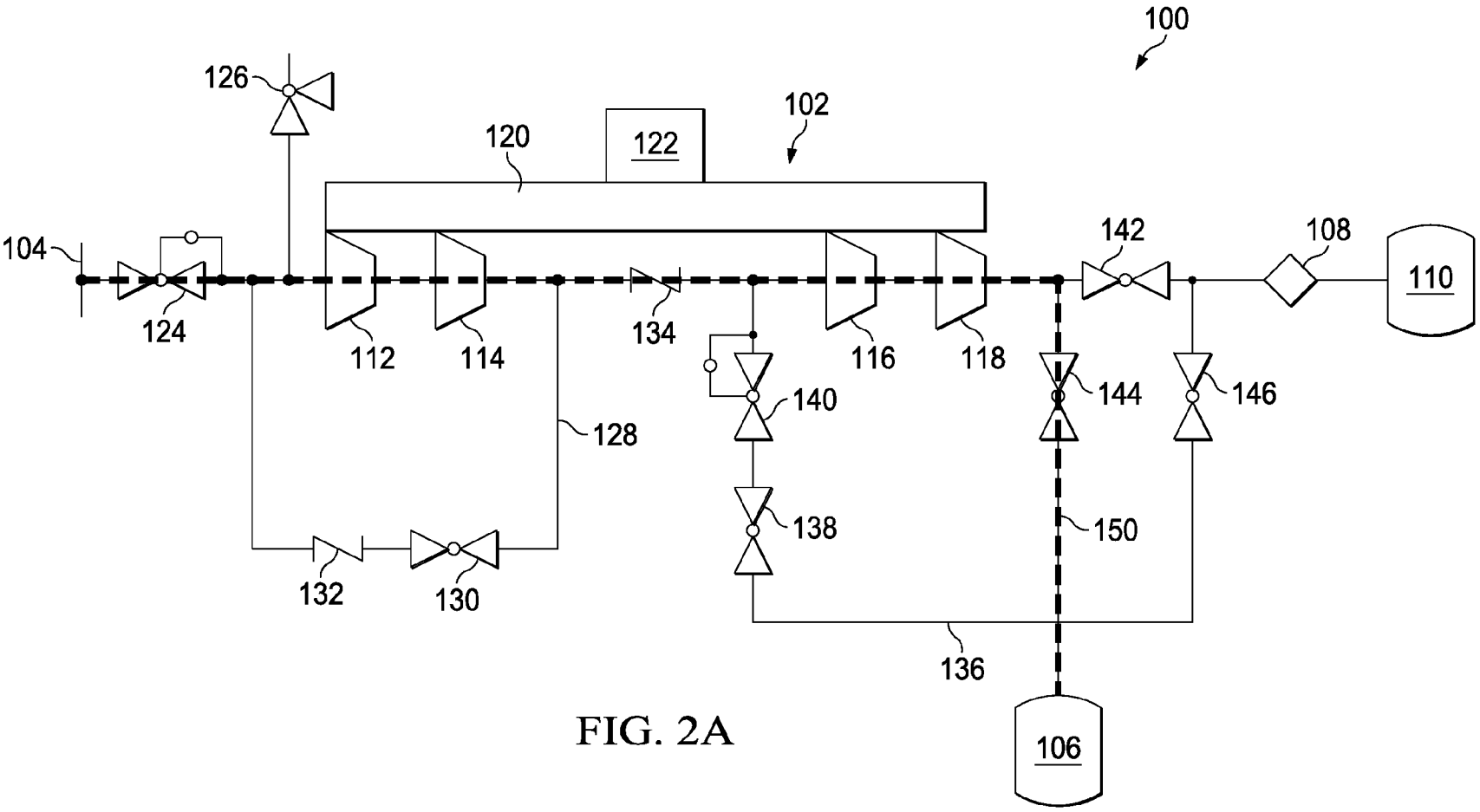
FIG. 2A is a schematic diagram of the CNG fueling system of FIG. 1 showing a flowpath utilized while receiving natural gas from a source, compressing the natural gas, and storing the natural gas in a storage tank.
Figure 2B:
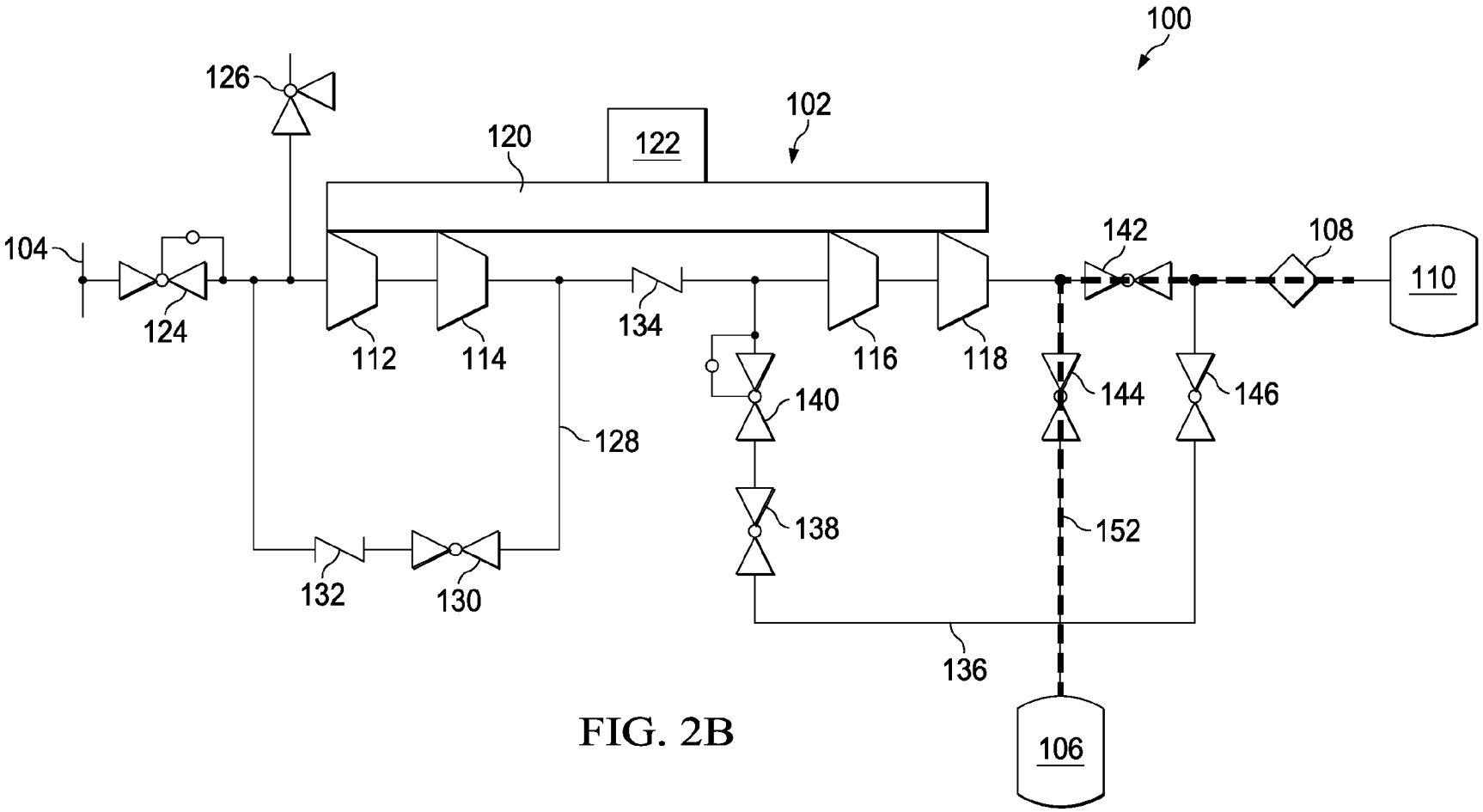
FIG. 2B is a schematic diagram of the CNG fueling system of FIG. 1 showing a flowpath utilized while transferring natural gas from a storage tank to a vehicle storage tank.
Figure 2C:
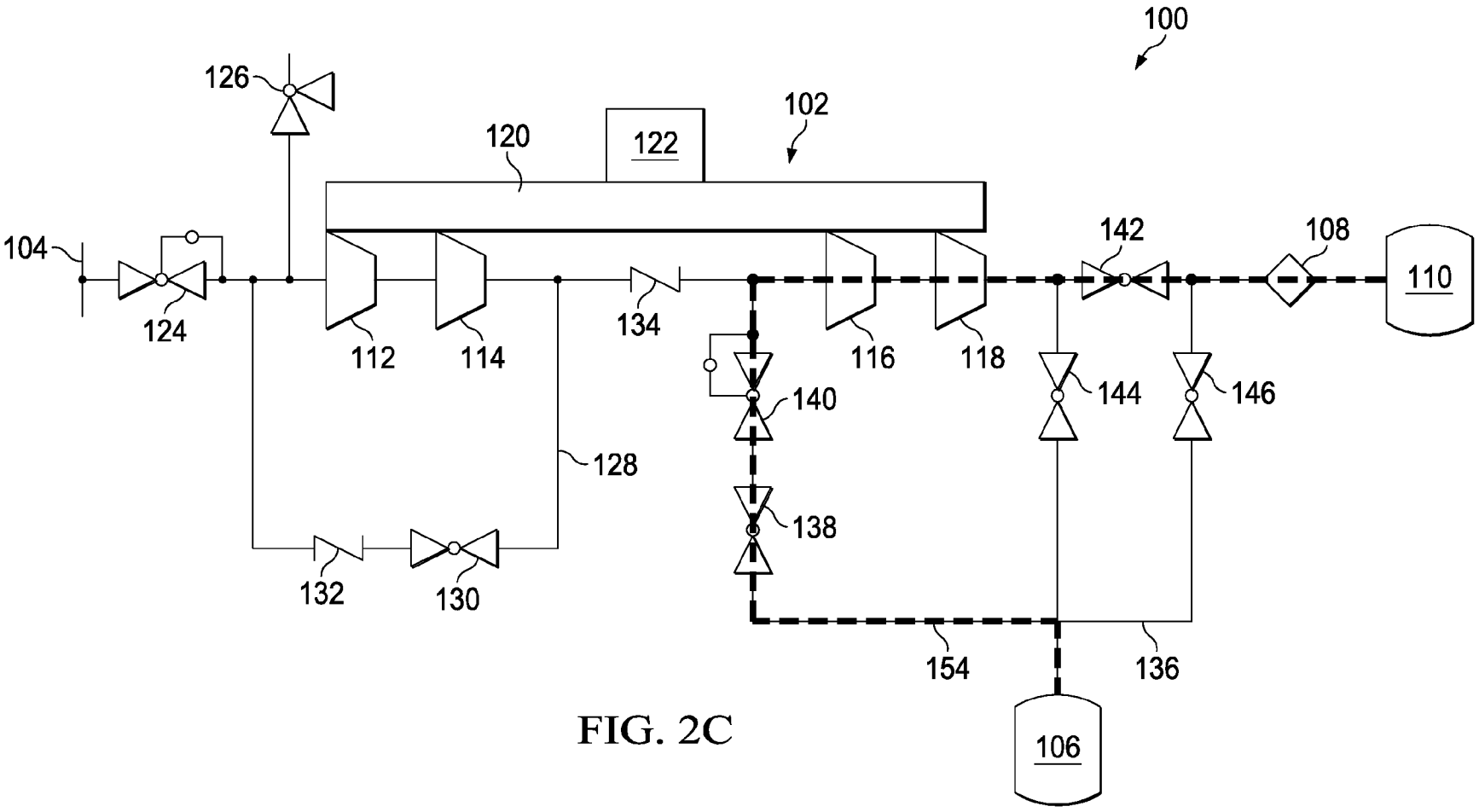
FIG. 2C is a schematic diagram of the CNG fueling system of FIG. 1 showing a flowpath utilized while providing natural gas from a storage tank to a compressor, compressing the natural gas, and transferring natural gas from the compressor to a vehicle storage tank.
Figure 2D:
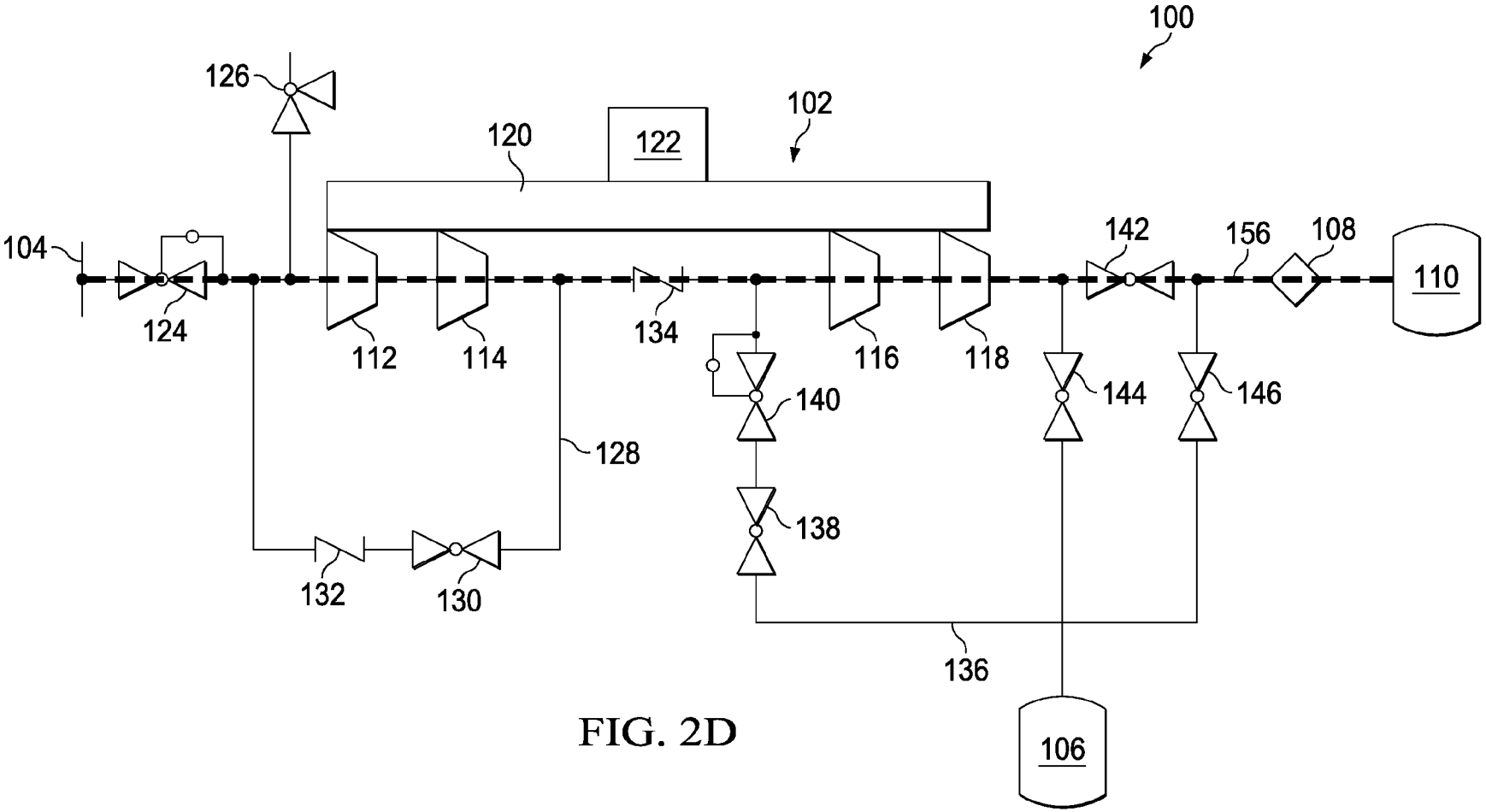
FIG. 2D is a schematic diagram of the CNG fueling system of FIG. 1 showing a flowpath utilized while receiving natural gas from a natural gas source, compressing the natural gas, and providing the compressed natural gas to a vehicle storage tank.

FIG. 2A is a schematic diagram of the CNG fueling system 100 of FIG. 1 showing a flowpath 150 that may be selectively utilized to receive natural gas from the natural gas source 104, compress natural gas using each of the compression stages 112, 114, 116, 118 of the compressor 102, and store the CNG in the storage tank 106. FIG. 2B is a schematic diagram of the CNG fueling system 100 of FIG. 1 showing a flowpath 152 that may be selectively utilized to transfer CNG from the storage tank 106 to a vehicle storage tank 110 via the dispenser 108. FIG. 2C is a schematic diagram of the CNG fueling system 100 of FIG. 1 showing a flowpath 154 that may be selectively utilized to provide CNG from the storage tank 106 to the compressor 102, further compress the CNG, and transfer the further compressed CNG from the compressor 102 to the vehicle storage tank 110 via the dispenser 108. In some embodiments, during operation of the compressor 102 as shown in FIG. 2C, the stage bypass valve 130 may be open to direct an output of the second compression stage 114 to an input of the first compression stage 112 thereby generally operating the first and second compression stages 112, 114 in an unloaded state while operating the third and fourth stages 116, 118 in a loaded state. FIG. 2D is a schematic diagram of the CNG fueling system 100 of FIG. 1 showing a flowpath 156 that may be selectively utilized to receiving natural gas from the natural gas source 104, compress the natural gas, and providing the CNG to the vehicle storage tank 110 via the dispenser 108.

In some embodiments, an output pressure of the first compression stage 112 may range from about 100 psig to about 1000 psig. In some embodiments, an output pressure of the second compression stage 114 may range from about 350 psig to about 1000 psig. In some embodiments, CNG may be supplied to the input of the third compression stage 116 at a pressure ranging from about 350 psig to about 1200 psig. In some embodiments, an output pressure of the third compression stage 116 may range from about 1000 psig to about 3000 psig. In some embodiments, CNG may be supplied to the input of the fourth compression stage 118 at a pressure ranging from about 1000 psig to about 3000 psig. In some embodiments, an output pressure of the fourth compression stage 118 may range from about 2000 psig to about 5000 psig.

In this embodiment, an output of the fourth compression stage 118 and the dispenser 108 may be selectively connected and/or disconnected from fluid communication with each other by a valve 142. Further, the storage tank 106 may be selectively connected in fluid communication with an input of the valve 142 via a valve 144. Similarly, the storage tank 106 may be selectively connected and/or disconnected in fluid communication with an output of the valve 142 via a valve 146.

Figure 3:
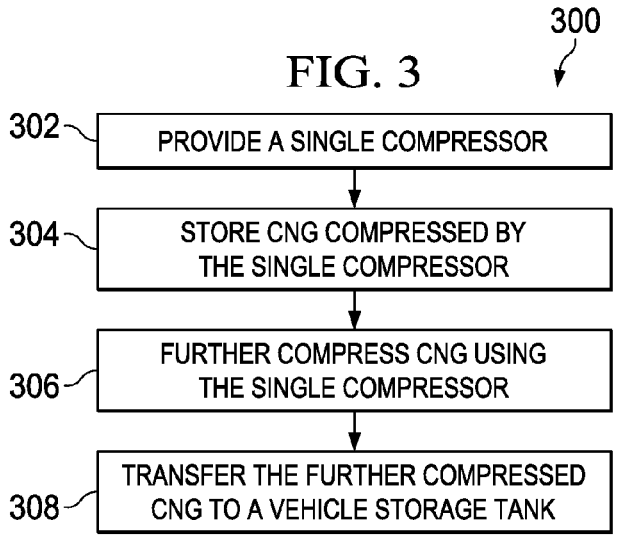
FIG. 3 is a flowchart of a method of transferring fuel to a vehicle storage tank according to an embodiment of the disclosure.

Referring now to FIG. 3, a method 300 of transferring fuel to a vehicle storage tank is shown according to an embodiment of the disclosure. The method 300 may begin at block 302 by providing a single compressor, such as a compressor 102. In some embodiments, a grouping of gas compression components may be a single compressor if at least one of (1) the gas compression components (i.e. pistons and/or the like) are driven by a single and/or shared rotating input, such as, but not limited to, a crankshaft of a power transfer device 120 and (2) the gas compression components and/or the power transfer devices are driven by a single and/or shared compressor driver, such as, but not limited to, a single compressor driver 122 (i.e. electric motor). The method 300 may continue at block 304 by storing CNG compressed by the single compressor. The method 300 may continue at block 306 by further compressing the stored CNG using the single compressor. The method 300 may continue at block 308 by transferring the further compressed CNG to a vehicle storage tank 110.

In some cases, a CNG fueling system 100 may operate as shown in FIG. 2A until the storage tank 106 has reached a maximum capacity at a selected CNG pressure, in some cases, about 4500 psig to about 5000 psig. With the storage tank 106 full, the compressor 102 may turn off. Next, CNG may be provided to a vehicle storage tank 110 from the storage tank 106 as shown in FIG. 2B until the storage tank 106 and the vehicle storage tank 110 either equalize or until a mass flow rate or transfer rate of CNG falls below a predetermined threshold value. In some embodiments, when the above-described equalization or predetermined threshold value is reached, or when a lower predetermined pressure of the storage tank 106 is reached, the CNG fueling system 100 may operate as shown in FIG. 2C to direct CNG from the storage tank 106 to at least one of the compression stages 112, 114, 116, 118 of the compressor 102 and transfer the further compressed CNG from the running compressor 102 to the vehicle storage tank 110. In some embodiments, after another predetermined lower pressure threshold of the storage tank 106 is reached, the system may continue to provide CNG to the vehicle storage tank 110 by operating as shown in FIG. 2D until the vehicle storage tank 110 is full as indicated by pressure, weight, change in mass flow rate, and/or any other suitable determinative factor. In the manner described above, a single compressor may be utilized to quickly fill a vehicle storage tank with CNG even when the natural gas source is provided at a relatively low pressure.

Figure 4:
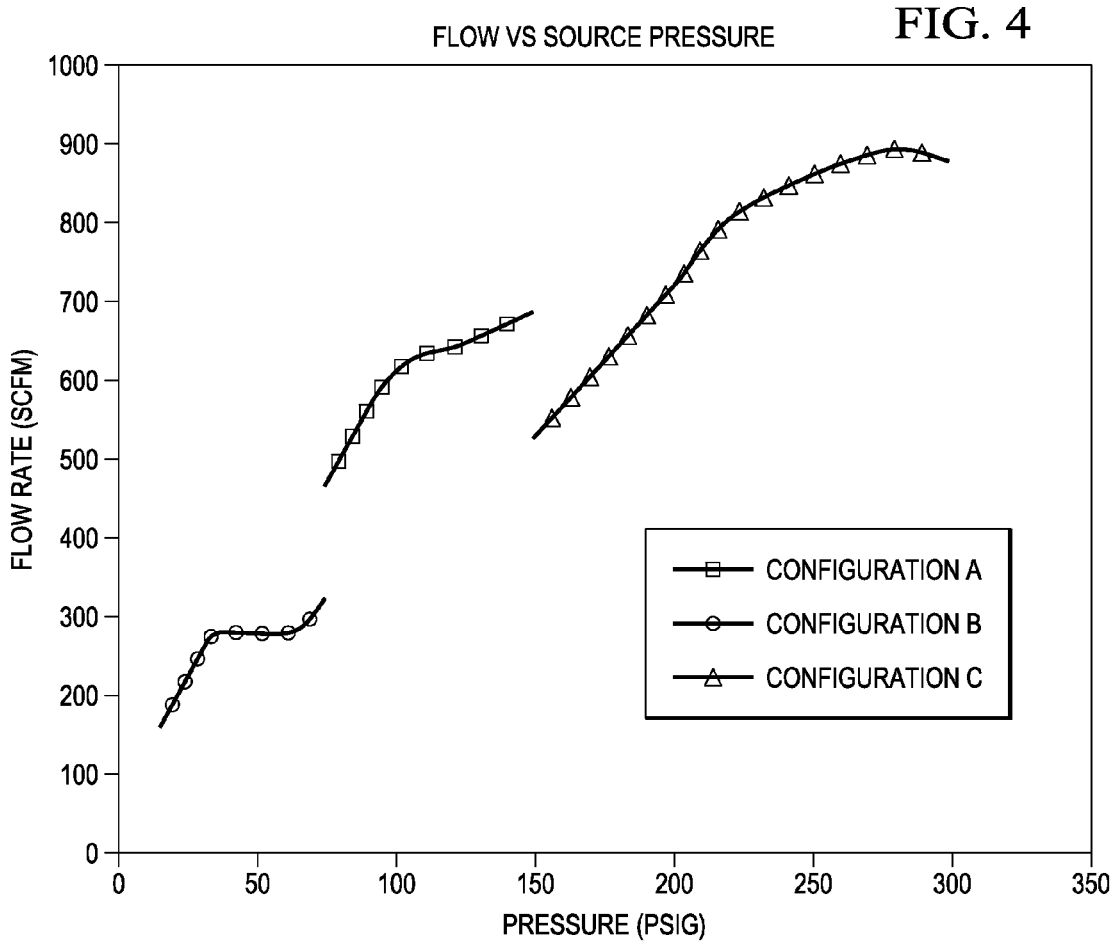
FIG. 4 is a chart comparing gas flow versus natural gas source pressure for three different configurations of the CNG fueling system of FIG. 1.
Figure 5:
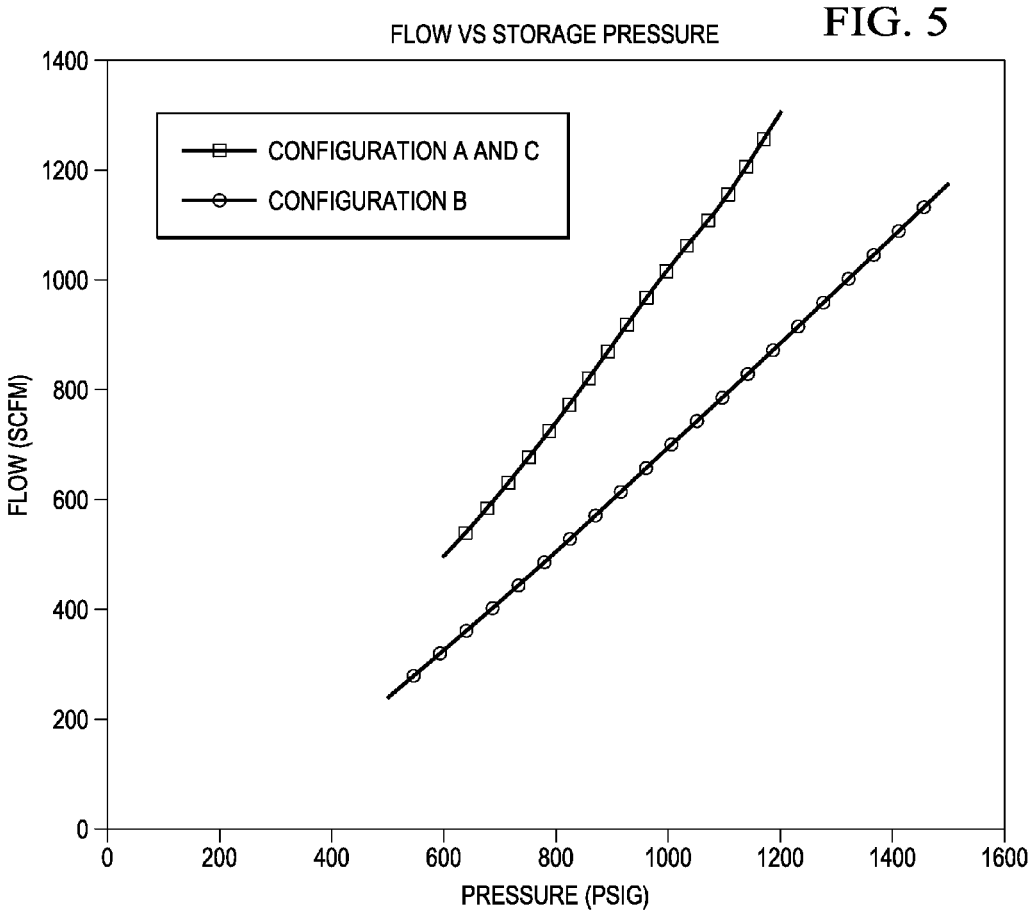
FIG. 5 is a chart comparing gas flow versus storage tank pressure for the three different CNG fueling system configurations of FIG. 4.

Referring now to FIG. 4, a chart comparing gas flow versus natural gas source pressure for three different configurations of the CNG fueling system of FIG. 1. FIG. 5 is a chart comparing gas flow versus storage tank pressure for the three different CNG fueling systems substantially similar to the CNG fueling system 100 configurations of FIG. 1. In each of FIGS. 4 and 5, reference is made to configurations A, B, and C. Each of configurations A, B, and C illustrate operation of CNG fueling systems 100 with an electric motor compressor drive 122 driving a single and/or shared crankshaft of a power transfer device 120 at 1800 rpm with a 3 inch stroke length. The differences between configurations A, B, and C are the compressor driver 122 size (horsepower), the number of compression stages, and the cylinder bore diameter of the compressions stages of the separable CNG compressor 102. Configuration A comprises a 250 HP electric motor, a 1st stage 7¼" bore, a 2nd stage 4⅛" bore, a 3rd stage 3⅜" bore, and a 4th stage 1¾" bore, where CNG is fed back to the 3rd and 4th stage during operation substantially similar to that shown in FIG. 2C. Configuration B comprises a 125 HP electric motor, a 1st stage 8" bore, a 2nd stage 4⅛" bore, a 3rd stage 3" bore, and a 4th stage 1½" bore, where CNG is fed back to the 3rd and 4th stage during operation substantially similar to that shown in FIG. 2C. Configuration C comprises a 250 HP electric motor, a 1st stage 4⅛" bore, a 2nd stage 3⅜" bore, and a 3rd stage 1¾" bore, where CNG is fed back to the 2nd and 3rd stage during operation substantially similar to that shown in FIG. 2C.

Figure 6:
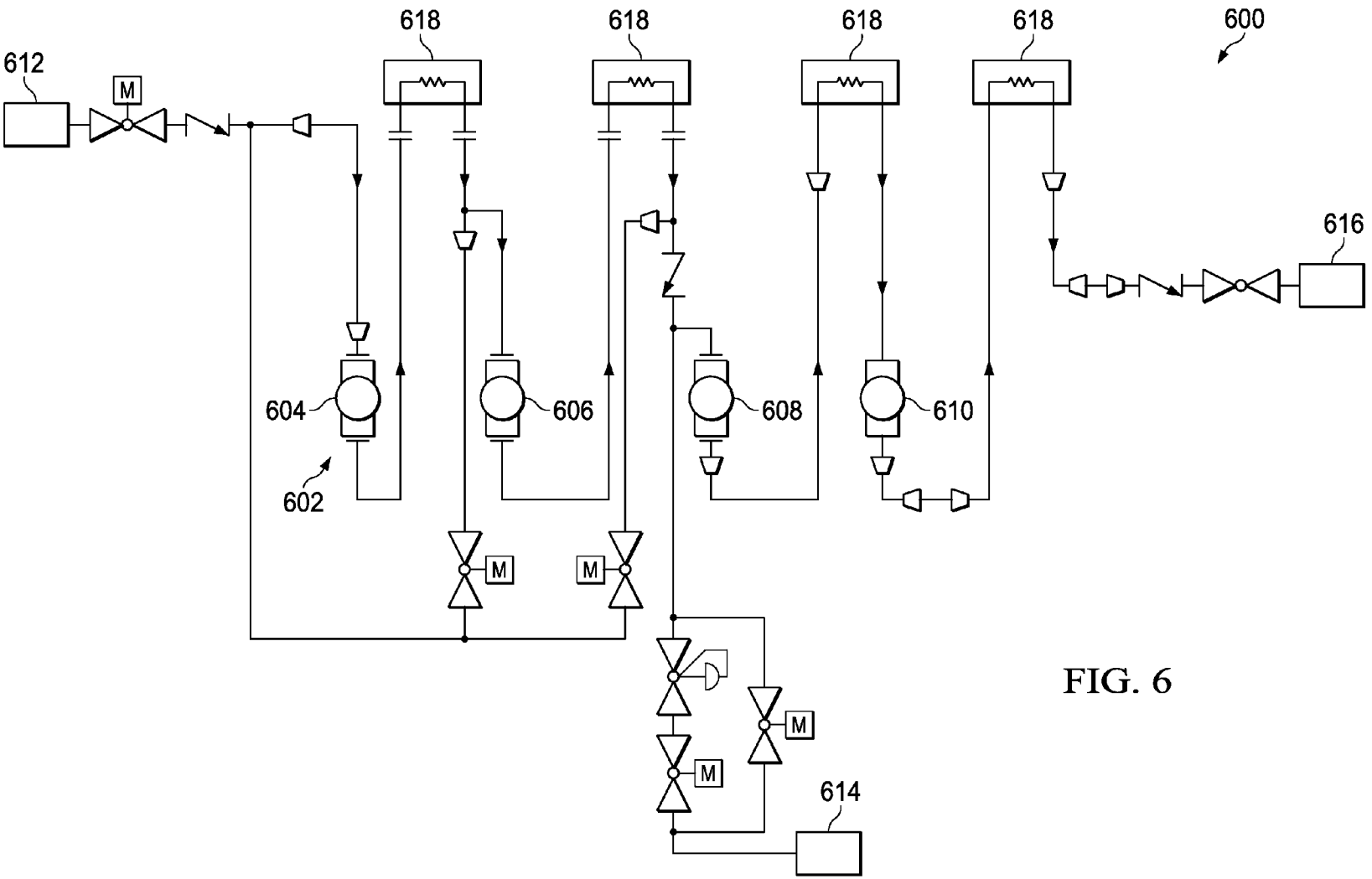
FIG. 6 is a schematic diagram of a CNG fueling system according to another embodiment of the disclosure.

FIG. 6 is a schematic diagram of a CNG fueling system 600 according to another embodiment of the disclosure. CNG fueling system 600 is substantially similar to CNG fueling system 100. CNG fueling system 600 comprises a single compressor 602 comprising a first compression stage 604, a second compression stage 606, a third compression stage 608, and a fourth compression stage 610. Also like CNG fueling system 100, CNG fueling system 600 is configured to receive natural gas from a relatively low pressure natural gas source 612 having a pressure of about 330 psig or less. The CNG fueling system 600 may be configured to compress natural gas and deliver the CNG to each of a storage tank 614 and a vehicle storage tank 616. The CNG fueling system 600 may be operated substantially in accordance with the method 300 to quickly fuel a vehicle storage tank 616. CNG fueling system 600 further comprises a plurality of heat exchangers 618 through which CNG may be passed to manage a temperature of the CNG as it moves relative to the compression stages 604, 606, 608, 610.

Figure 7:
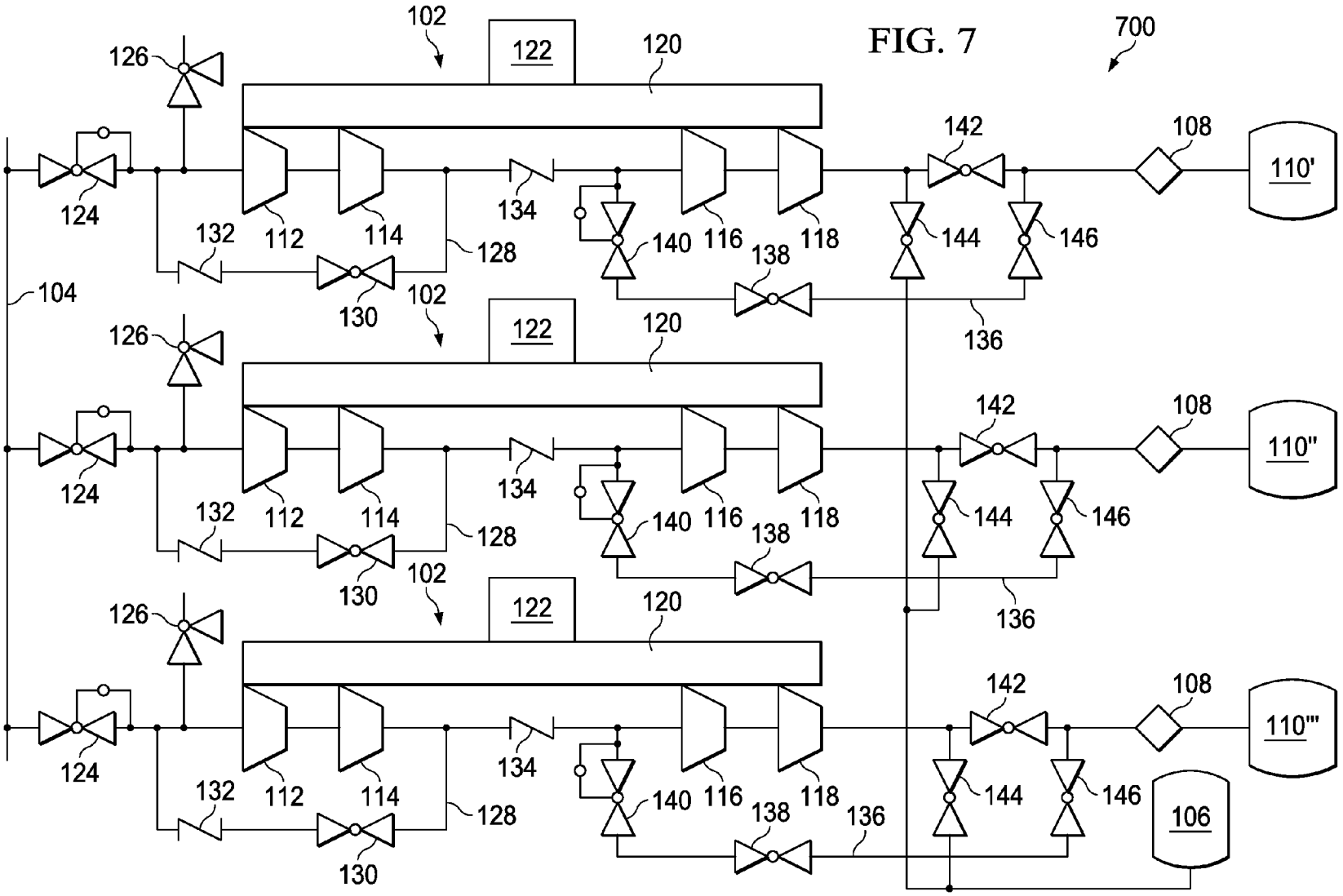
FIG. 7 is a schematic diagram of another CNG fueling system according to another embodiment of the disclosure.

Referring now to FIG. 7, a schematic diagram of a CNG fueling system 700 according to another embodiment of the disclosure is shown. CNG fueling system 700 comprises a plurality of compressors 102 that are substantially similar to compressors 102 of CNG fueling system 100. Each compressor 102 may be provided natural gas from the natural gas source 104. In this embodiment, multiple vehicle storage tanks 110', 110", 110'" may be provided CNG by CNG fueling system 700 substantially independently of each other. In this embodiment, each compressor 102 may be configured to deliver CNG to a shared and/or same storage tank 106. In alternative embodiments, a CNG storage selection header may be provided that comprises any necessary pipes, valves, and/or control systems useful in selectively directing a CNG output from any combination of compressors 102 to storage tank 106 and/or to any combination of a plurality of storage tanks 106. In alternative embodiments, a dispenser selection header may be provided that comprises any necessary pipes, valves, and/or control systems useful in selectively directing a CNG output from any combination of compressors 102 to any combination of the plurality of dispensers 108.

Figure 8:
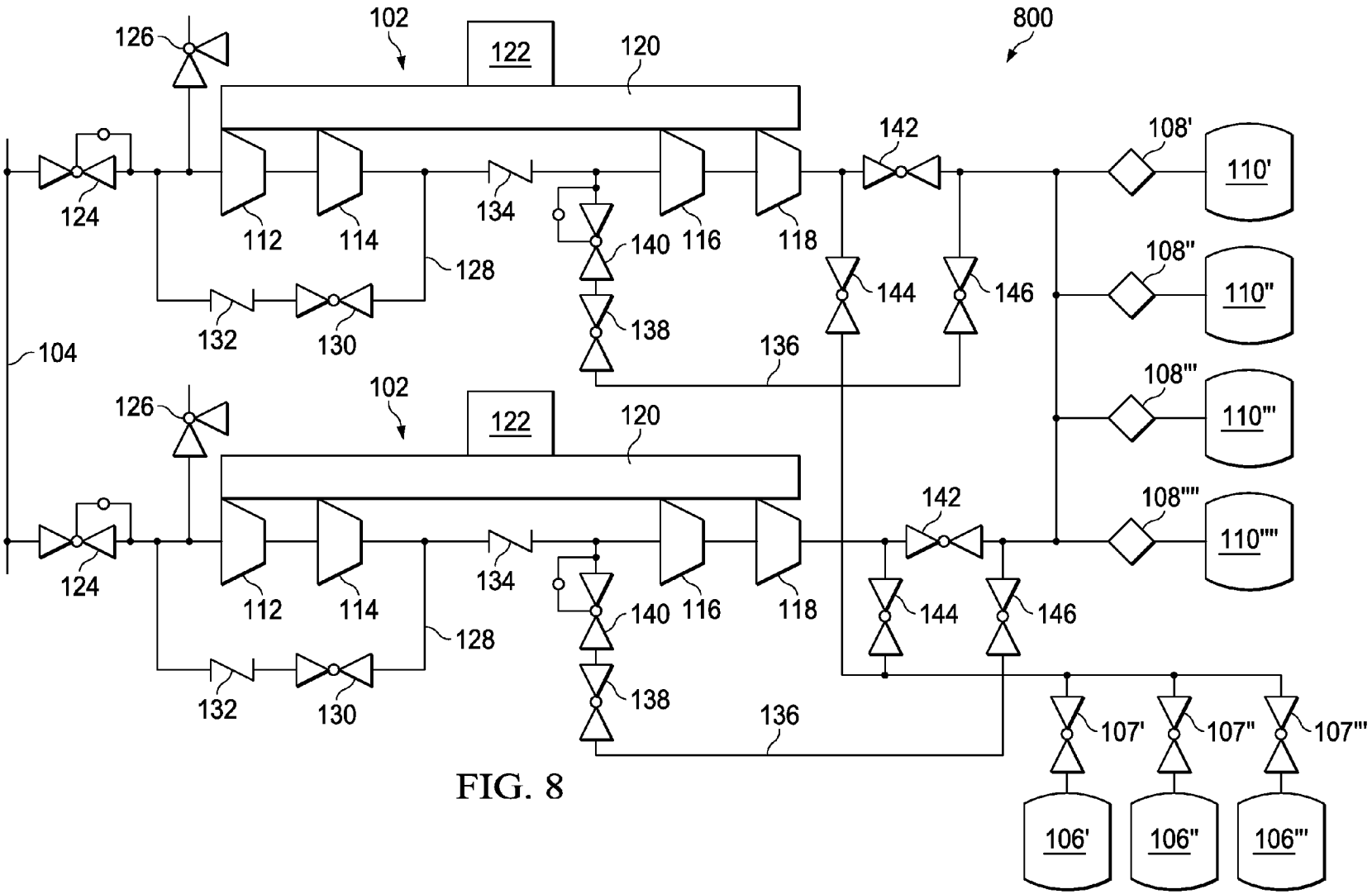
FIG. 8 is a schematic diagram of another CNG fueling system according to another embodiment of the disclosure.

Referring now to FIG. 8, a schematic diagram of a CNG fueling system 800 according to another embodiment of the disclosure is shown. CNG fueling system 800 comprises a plurality, of compressors 102 that are substantially similar to compressors 102 of CNG fueling system 100. Each compressor 102 may be provided natural gas from the natural gas source 104. In this embodiment, multiple vehicle storage tanks 110', 110", 110'", 110'" may be provided CNG by CNG fueling system 800 substantially independently of each other. In this embodiment, each compressor 102 may be configured to deliver CNG to a shared and/or same storage tank 106. In this embodiment, each storage tank 106', 106", 106'" is provided with a tank valve 107', 107", 107'", respectively, to allow any combination of selections of storage tanks 106', 106", 106'" to receive and/or provide CNG. In alternative embodiments, a CNG storage selection header may be provided that comprises any necessary pipes, valves, and/or control systems useful in selectively directing a CNG output from any combination of compressors 102 to storage tanks 106', 106", 106'". In alternative embodiments, a dispenser selection header may be provided that comprises any necessary pipes, valves, and/or control systems useful in selectively directing a CNG output from any combination of compressors 102 to any combination of the plurality of dispensers 108', 108", 108'", 108"".

Figure 9:
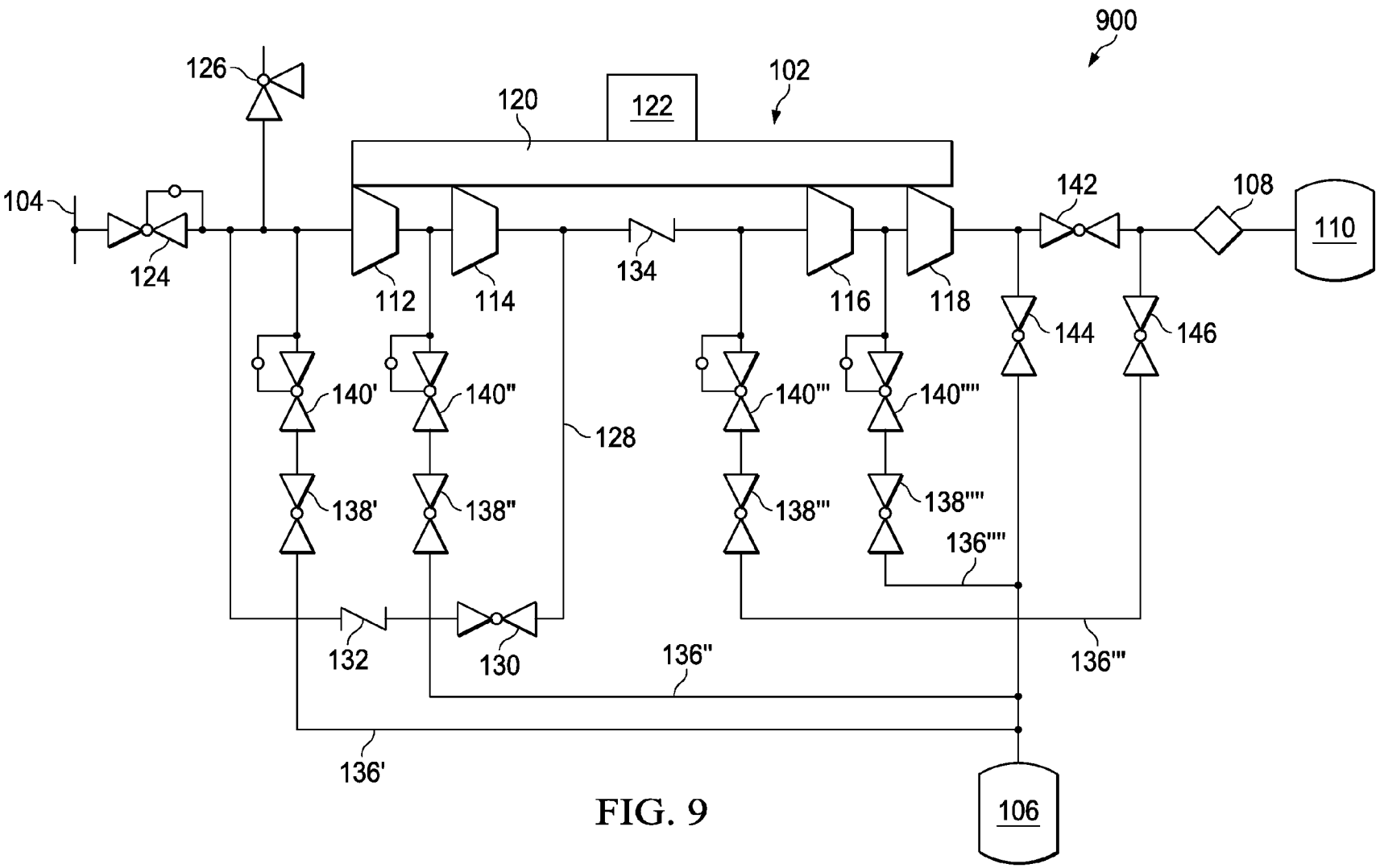
FIG. 9 is a schematic diagram of another CNG fueling system according to another embodiment of the disclosure.

Referring now to FIG. 9, a schematic diagram of a CNG fueling system 900 according to another embodiment of the disclosure is shown. CNG fueling system 900 is substantially similar to CNG fueling system 100. However, CNG fueling system 900 comprises a plurality of storage feedbacks 136', 136", 136'", 136"". In this embodiment, each storage feedback 136', 136", 136'", 136"" is associated with their own dedicated feedback valves 138 (namely feedback valves 138', 138", 138'", 138"", respectively) and feedback regulator valves 140 (namely feedback regulator valves 140', 140", 140'", 140"", respectively). In some embodiments, the CNG fueling system 900 may control feedback valves 138', 138", 138'", 138"" to selectively feed CNG back from storage tank 106 to any combination of compression stages 112, 114, 116, 118, sequentially and/or simultaneously. In some embodiments, additional CNG storage tanks may be provided and selectively filled to comprise CNG at pressures higher or lower than storage tank 106. In alternative embodiments, a feedback header may be provided that comprises any necessary pipes, valves, and/or control systems useful in selectively directing a CNG output from any combination of storage tanks 106 to any combination of the plurality of compression stages 112, 114, 116, 118 via the storage feedbacks 136', 136", 136'", 136"".

In some embodiments, the CNG fueling system 900 may be operated to feed CNG back from storage tank 106 to fourth compression stage 118 via storage feedback 136'''' until the pressure of the CNG supplied by the storage tank 106 is reduced to a first predetermined threshold pressure. In some embodiments, the first predetermined threshold pressure may be associated with a lower end of a desirable input pressure range of the fourth compression stage 118. Once the first predetermined threshold pressure is reached, the CNG fueling system 900 may be operated to discontinue feeding CNG back from storage tank 106 to fourth compression stage 118.

In some embodiments, the CNG fueling system 900 may be operated to feed CNG back from storage tank 106 to third compression stage 116 via storage feedback 136''' until the pressure of the CNG supplied by the storage tank 106 is reduced to a second predetermined threshold pressure. In some embodiments, the second predetermined threshold pressure may be associated with a lower end of a desirable input pressure range of the third compression stage 116. Once the second predetermined threshold pressure is reached, the CNG fueling system 900 may be operated to discontinue feeding CNG back from storage tank 106 to third compression stage 116.

In some embodiments, the CNG fueling system 900 may be operated to feed CNG back from storage tank 106 to second compression stage 114 via storage feedback 136'' until the pressure of the CNG supplied by the storage tank 106 is reduced to a third predetermined threshold pressure. In some embodiments, the third predetermined threshold pressure may be associated with a lower end of a desirable input pressure range of the second compression stage 114. Once the third predetermined threshold pressure is reached, the CNG fueling system 900 may be operated to discontinue feeding CNG back from storage tank 106 to second compression stage 114.

In some embodiments, the CNG fueling system 900 may be operated to feed CNG back from storage tank 106 to first compression stage 112 via storage feedback 136' until the pressure of the CNG supplied by the storage tank 106 is reduced to a fourth predetermined threshold pressure. In some embodiments, the fourth predetermined threshold pressure may be associated with a lower end of a desirable input pressure range of the first compression stage 112. Once the fourth predetermined threshold pressure is reached, the CNG fueling system 900 may be operated to discontinue feeding CNG back from storage tank 106 to first compression stage 112. In some embodiments, once the CNG fueling system 900 discontinues feeding CNG back from storage tank 106 to first compression stage 112, the CNG fueling system 900 may begin operation substantially similar to that shown in FIG. 2D to complete fueling a vehicle storage tank 110.

While the CNG fueling systems disclosed above are described with specificity, it will be appreciated that alternative embodiments of CNG fueling systems are contemplated that comprise any necessary header and/or fluid distribution systems useful in selectively connecting any of the component parts of the CNG fueling systems in any combination. For example, alternative embodiments may comprise headers, valves, pipes, control systems, and/or any other suitable device for selectively connecting one or more storage tanks to one or more compressors, compression stages, dispensers, vehicle storage tanks, alternative natural gas supplies, and/or any other suitable interface. Similarly, alternative embodiments may comprise headers, valves, pipes, control systems, and/or any other suitable device for selectively connecting one or more compressors and/or compression stages to one or more compressors, compression stages, dispensers, vehicle storage tanks, alternative natural gas supplies, and/or any other suitable interface. Similarly, alternative embodiments may comprise headers, valves, pipes, control systems, and/or any other suitable device for selectively connecting one or more dispensers to one or more compressors, compression stages, dispensers, vehicle storage tanks, alternative natural gas supplies, and/or any other suitable interface. Similarly, alternative embodiments may comprise headers, valves, pipes, control systems, and/or any other suitable device for selectively connecting one or more vehicle storage tanks to one or more compressors, compression stages, dispensers, alternative natural gas supplies, and/or any other suitable interface. In some embodiments, the above-described systems and methods may comprise systems and/or methods for being implemented in an automated, semi-automated, programmed, electronically controlled, manual, and/or computer controlled nature. In some embodiments, the above-described systems and methods may be remotely controlled and/or robotically assisted.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A method of operating a compressed natural gas (CNG) fueling system, comprising:

providing a single compressor comprising a first compression stage and a subsequent compression stage, wherein the first compression stage feeds the subsequent compression stage when filling a storage tank;

compressing CNG using at least one of the first compression stage and the subsequent compression stage when filling the storage tank;

storing CNG compressed by the at least one of the first compression stage and the subsequent compression stage of the compressor in the storage tank; and further compressing the stored CNG using the compressor by feeding the stored CNG back to the subsequent compression stage of the compressor that compressed the CNG prior to storing the CNG in the storage tank, the CNG being introduced back into the compressor at a location downstream relative to an output of the first compression stage;

wherein the first compression stage is configured to receive natural gas at pressures equal to or lower than 300 psig.

2. The method of claim 1, wherein the compressor comprises a single power transfer device.

3. The method of claim 1, wherein the compressor comprises a single crankshaft.

4. The method of claim 1, wherein the compressor comprises a single compressor driver.

5. The method of claim 1, wherein the compressor comprises a single electric motor.

6. A compressed natural gas (CNG) fueling system, comprising:

a single compressor comprising a first compression stage and a subsequent compression stage, wherein the first compression stage feeds the subsequent compression stage when filling a storage tank;

the storage tank being configured to receive CNG from at least one of the first compression stage and the subsequent compression stage of the compressor when filling the storage tank; and a CNG feedback to the subsequent compression stage of the compressor from the storage tank, the CNG being introduced back into the compressor at a location downstream relative to an output of the first compression stage;

wherein the first compression stage is configured to receive natural gas at pressures equal to or lower than 300 psig.

7. The CNG fueling system of claim 6, wherein the compressor comprises a single power transfer device.

8. The CNG fueling system of claim 6, wherein the compressor comprises a single crankshaft.

9. The CNG fueling system of claim 6, wherein the compressor comprises a single compressor driver.

10. The CNG fueling system of claim 6, wherein the compressor comprises a single electric motor.

* * * * *